United States Patent [19]

Wittmann et al.

[11] Patent Number: 4,468,048

[45] Date of Patent: Aug. 28, 1984

[54] SAFETY SKI BINDING

[75] Inventors: Heinz Wittmann, Vienna; Josef Svoboda, Schwechat, both of Austria

[73] Assignee: TMC Corporation, Baar, Switzerland

[21] Appl. No.: 351,579

[22] Filed: Feb. 23, 1982

[30] Foreign Application Priority Data

Feb. 26, 1981 [AT] Austria ..... 887/81

[51] Int. Cl.[3] ..... A63C 9/00

[52] U.S. Cl. ..... 280/614; 280/631

[58] Field of Search ..... 280/614, 615, 618, 633, 280/631, 626

[56] References Cited

U.S. PATENT DOCUMENTS

| | | | |
|---|---|---|---|
| 2,072,472 | 3/1937 | Dodd | 280/614 |
| 2,698,757 | 1/1955 | Berlenbach | 280/614 |
| 3,845,964 | 11/1974 | Johnson | 280/631 |
| 3,870,327 | 3/1975 | Betschart | 280/618 |

FOREIGN PATENT DOCUMENTS

| | | | |
|---|---|---|---|
| 45187 | 12/1910 | Austria | 280/618 |
| 2055326 | 5/1972 | Fed. Rep. of Germany | 280/618 |
| 2902702 | 8/1979 | Fed. Rep. of Germany | 280/633 |
| 2846475 | 5/1980 | Fed. Rep. of Germany | 280/615 |
| 63723 | 9/1968 | German Democratic Rep. | 280/626 |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A safety ski binding for cross-country and downhill skiing includes a cross-country plate which is divided into two pivotally connected parts. A sole holder for a ski shoe includes a hold-down means and a pin secured thereon, the pin being movably supported in a recess in the front part of the cross-country plate. The hold-down means engages the upper side of the front end of the ski shoe sole. An operating member is operatively coupled to the sole holder and, in response to upward movement of the rear part of cross-country plate and/or downward movement of the tip of the ski shoe sole, effects generally downward movement of the hold-down means so that it remains in engagement with the top of the ski shoe sole. A spring cooperable with the sole holder or the operating member is effective to yieldably urge the hold-down means generally upwardly.

18 Claims, 7 Drawing Figures

SAFETY SKI BINDING

FIELD OF THE INVENTION

This invention relates to a safety ski binding and, more particularly, to a binding for cross-country skiing and downhill skiing which has a cross-country plate which either is divided into two parts connected by means of a joint or is a continuous flexible plate, the front part of the cross-country plate carrying a sole holder which has hold-down means for the sole of a shoe and is supported in a preferably cylindrical recess in the cross-country plate by means of a pin which extends approximately perpendicular to the cross-country plate.

BACKGROUND OF THE INVENTION

A safety ski binding of the above-mentioned type is, for example, described in Austrian Pat. No. 343 522. The cross-country plate which is divided and jointed in the area of the ball of the foot permits a bending of the shoe sole during walking, but since the front area of the cross-country skiing shoes, in order to facilitate walking is bent slightly upwardly, the hold-down means of the sole holder digs into the uppers of the cross-country skiing shoe, due to the rolling of the ski shoe sole over the joint. Also, the hold-down means looses its lateral grip on the sole of the shoe whereby the shoe can tilt laterally, which on the one hand influences the control of the cross-country skiing shoe over the sole holder and on the other hand produces excessive loads on other binding parts. Safety ski bindings suited for cross-country skiing are also known in which the cross-country plate is a continuous, flexible plate, but these types of construction also have the above-mentioned disadvantages.

A purpose of the invention is to provide a safety ski binding of the above-mentioned type which does not have these disadvantages and in which, during each phase of the sequence of movement produced by the cross-country skiing, sufficient contact is assured between the sole holder and the ski shoe sole.

SUMMARY OF THE INVENTION

This purpose is attained inventively by providing a binding of the above-mentioned type in which the effective vertical position of the sole holder can be regulated by one end of an operating member, the other end of which is either supported or secured in the area of the ball of the foot or is hinged to the joint, whereby during cross-country skiing either the shoe sole or the cross-country plate operatively engages the operating member, preferably at such other end, whereby the sole holder can be moved toward the upper side of the ski. Through the inventive measures, vertical adjustment of the sole holder is automatically effected by the operating member during cross-country skiing. Thus, the sole holder continuously follows movement of the shoe sole, which rolls over the joint, whereby damage to the ski shoe uppers is avoided and the control of the sole holder by the shoe is improved.

A change in the effective vertical position of the sole holder can occur inventively in a simple manner by the sole holder being supported movably in a cylindrical recess provided in the cross-country plate and being urged away from the upper side of the ski by a spring which is arranged between the cross-country plate and the down-holding means and urges the sole holder upwardly toward an initial position.

The operating member can be constructed inventively as a pedal which is hinged at one end on the joint and the other end of which either engages the pin of the sole holder or controls the sole holder through an interpositioned tilting member. This embodiment permits operation of the pedal directly by the sole of the ski shoe which rolls over the joint, by the degree of movement or tilting of the sole holder being adjustable through the selection of the angle of pitch of the pedal relative to the upper side of the cross-country plate.

A further characteristic of the invention relates to the recess of the cross-country plate which receives the pin of the sole holder. More specifically, this recess preferably is widened to define a frustoconical surface at the portion thereof nearest the operating member, and is otherwise designed generally cylindrically. Thus, applying forces to the tilting member with the operating member assures a tilting movement of the sole holder toward the operating member, the operating member being influenced by a spring which is cooperable with the cross-country plate and the operating member for urging the latter toward its nonoperated position.

A structurally simple arrangement of the tilting member results, according to a further characteristic of the invention, by same being fixedly connected to the sole holder and having two laterally spaced extensions, the ends of which extensions which face the operating member each having a slotlike hole or the like which receives the end of the operating member which is remote from the joint. In this manner, the existing structural conditions are best utilized.

A further characteristic of the invention consists in the operating member being constructed as a rope, a band or the like having one end secured to the rear part of the cross-country plate in the area of the joint, being guided within the front part of the cross-country plate and deflected by a roller, a bolt or the like toward the pin of the sole holder, and having its other end secured to such pin. This embodiment needs no separate structural part which projects from the plane of the cross-country plate. Operation of this embodiment occurs during cross-country skiing by lifting the rear part of the cross-country plate.

It is also possible to inventively construct the operating member as an extension arranged on the rear part of the cross-country plate in the area of the joint. This extension, during a swinging up of the rear part of the cross-country plate, moves a slide member which is guided within the front part of the cross-country plate in a plane approximately parallel to the upper side of the plate and has an end remote from the ball joint which is bent at an acute angle with respect to the upper side of the ski and engages the inclined lower edge of a recess in the pin. In this embodiment, the pin of the cross-country plate can be pulled downwardly toward the upper side of the ski by the bent end of the slide member. Also, this embodiment is distinguished by its simple and advantageous construction.

BRIEF DESCRIPTION OF THE DRAWINGS

Further characteristics, advantages and details of the invention will now be described in greater detail with regard to the drawings, which illustrate several exemplary embodiments. The figures of the drawings illustrate only the details which are important with respect to the invention.

In the drawings.

DETAILED DESCRIPTION

Figure 1:
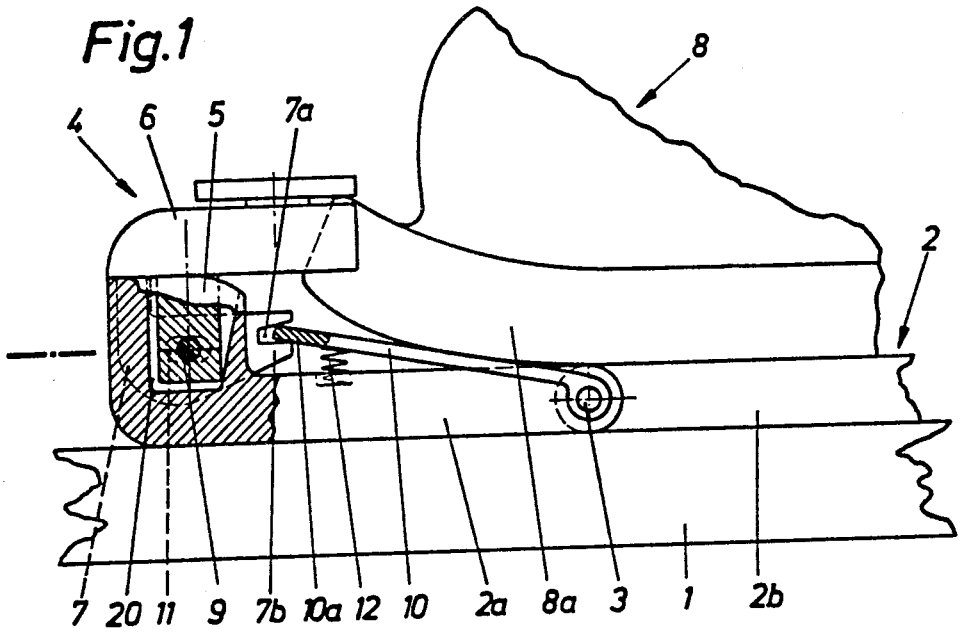
FIG. 1 is a fragmentary side view of a first exemplary embodiment of a safety ski binding embodying the invention.

A safety ski binding which is suitable for cross-country skiing is arranged on a ski 1. This binding has a cross-country plate 2 which consists of a front part 2*a* and a rear part 2*b* which in the area of the ball of the foot are pivotally connected by a joint 3. The cross-country plate 2 has at its front end area a sole holder 4 which consists of a sole hold-down means 6 and a pin 5 which is connected fixedly thereto. The pin 5 is received in a substantially cylindrical recess 20 provided in the cross-country plate 2, which recess is widened at the part thereof adjacent the ski shoe 8, the region of the widened portion forming a part of a frustoconical surface. A pin or axle 9 extends through an opening 11 in the pin 5, which opening 11 is arranged transversely to the longitudinal direction of the ski, and the pin 9 is supported on a ski-fixed and not illustrated housing of the jaw which also contains a conventional release mechanism which is not illustrated. The opening 11 is, as is particularly visible from FIG. 2*a*, widened in an hourglass or double cone shape with an axis lying in a plane parallel to the upper side of the ski 1, the degree of the widening controlling the horizontal swivelling range of the sole holder 4. On one hand, the cross-country plate 2 together with the sole holder 4 is pivotal about the pin 9, and on the other hand the sole holder 4 is pivotal alone, the pivotal range of which relative to the cross-country plate 2 is determined by the degree of widening of the recess 20 in the cross-country plate 2.

Figure 2B:
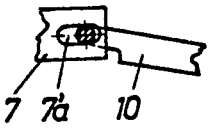
FIG. 2*b* is a side view of an alternative embodiment of part of the binding of FIG. 1.
Figure 2A:
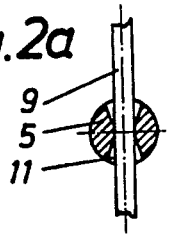
FIG. 2*a* is a sectional top view of a pin which is a component of the binding of FIG. 1.
Figure 2:
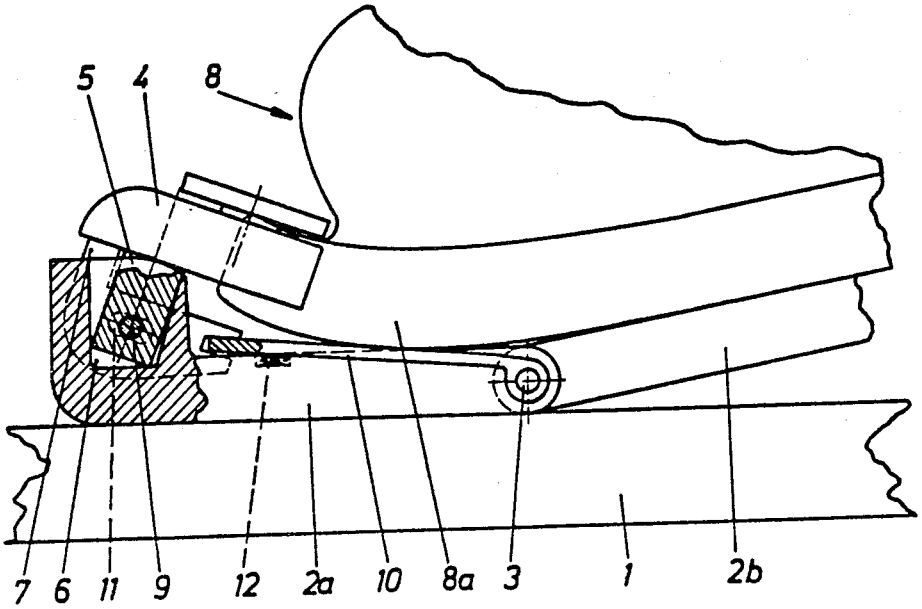
FIG. 2 is a fragmentary side view similar to FIG. 1 showing the binding of FIG. 1 in a different position of operation.

An operating member which is constructed as a pedal 10 is pivotally supported at the joint 3 which connects the two parts 2*a* and 2*b* of the cross-country plate. The end of the operating member 10 which is remote from the joint 3 engages two slotlike recesses 7*a* provided in a tilting member 7. The tilting member 7 is fixedly connected to a sole holder 4 and has two laterally spaced extensions 7*b* which project over the cross-country plate 2 toward the operating member 10. Provided in each of the extensions 7*b* is a respective one of the slotlike recesses 7*a*, which recesses open toward the operating member 10. As shown in FIG. 2*b*, it is alternatively possible to provide, in place of the recesses 7*a*, two bearing holes 7'*a* engaged by a bolt 10*a* arranged on the operating member 10. In either case, an elastic element, for example, a spring 12, is provided between the upper side of the cross-country plate 2 and the underside of a stepping area of the operating member 10, which elastic element urges the operating member 10 upwardly toward its nonoperated position.

When the cross-country ski shoe 8 is inserted into the binding, the tip of the ski shoe sole 8*a* is held in position by the sole holder 4. The underside of the slightly upwardly bent front area of the sole 8*a* of the cross-country shoe 8 rests on the operating member 10. When the rear of the ski shoe and thus the rear part 2*b* of the cross-country plate 2 are lifted off the ski during cross-country skiing, the shoe sole 8*a* rolls forwardly over the joint 3 and presses the operating member 10 downwardly, and the tilting member 7 which is operatively coupled to the operating member 10 causes the sole holder 4 to pivot about the pin 9 toward the shoe sole 8*a*. The sole holder 4 therefore follows the movement of the shoe sole 8*a*. Both digging of the hold-down means 6 into the upper part of the shoe 8 and also lateral tilting of the shoe 8 are thus prevented, and a secure holding of the ski shoe 8 during cross-country skiing is assured.

Figure 3:
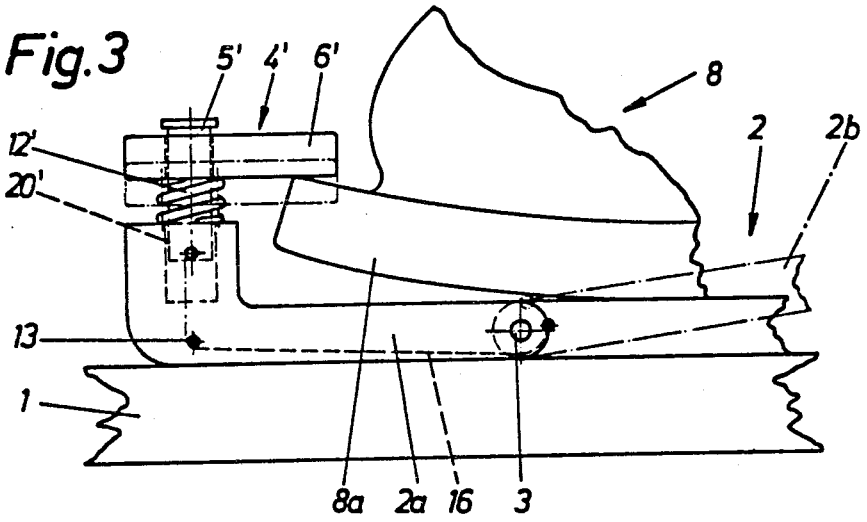
FIG. 3 is a side view of another alternative embodiment of the binding of FIG. 1.

In the exemplary embodiment according to FIG. 3, the pin 5' which carries the hold-down means 6' is vertically supported in a cylindrical opening 20' provided in the cross-country plate 2. A spring 12' which encircles the pin 5' between the hold-down means 6' and the cross-country plate 2 has one end supported on the cross-country plate 2 and the other end supported on the underside of the hold-down means 6', and urges the hold-down means 6' upwardly so that it is spaced from the cross-country plate 2 in its normal or downhill skiing position. One end of an operating member 16 which is preferably a band, a rope or the like is secured to the end of the pin 5' which is remote from the sole holder 4'. The operating member 16 extends, starting out from the pin 5' and within a recess provided in the cross-country plate 2, first toward the upper side of the ski 1 and then, after being deflected by a roller 13 supported rotatably in the cross-country plate 2, toward the joint 3 and the rear part 2*b* of the cross-country plate 2. The operating member 16 has its second end secured on the rear part 2*b* of the cross-country plate 2 in the region of the joint 3. This fastening is done so that a swinging up of the rear part 2*b* of the cross-country plate effects a partial rolling up of the operating member 16 on the joint 3, through which the pin 5', and with it the hold-down means 6', is pulled downwardly against the force of the spring 12' into the opening 20' in the cross-country plate 2. The sole holder 4' thus follows downward movement of the top of the shoe sole 8*a* as it rolls forwardly on the cross-country plate 2. Therefore, in each phase of the sequence of movement which occurs during cross-country skiing, proper engagement of the hold-down means 6' with the upper side of the shoe sole 8*a* is assured.

Figure 4:
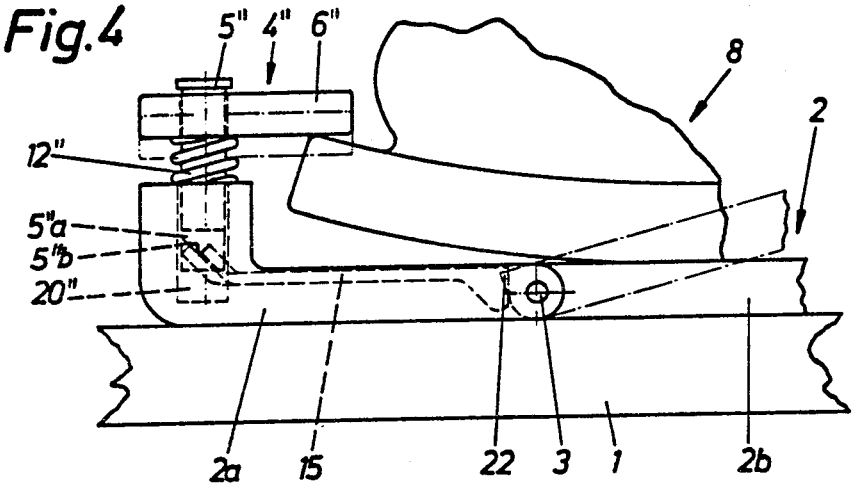
FIG. 4 is a side view of a further alternative embodiment of the binding of FIG. 1.

Similarly, in the exemplary embodiment illustrated in FIG. 4, the pin 5'' which carries the hold-down means 6'' is supported for vertical movement against force of the spring 12'' in the opening 21'' in the cross-country plate 2. The opening 20'' is deeper here than in the exemplary embodiment of FIG. 3, and the pin 5'' has a greater length. The rear part 2*b* of the cross-country plate 2 which is hinged at the joint 3 carries at its end adjacent the joint 3 an operating member which is an extension 22. The operating member 22, during swinging up of the rear part 2*b* of the cross-country plate 2, urges a slide member 15 leftwardly. The slide member 15 is, in the present exemplary embodiment, a plate-shaped structural part which is supported movably in the front part 2*a* of the cross-country plate approximately parallel with respect to the upper side thereof.

The end of the slide member 15 remote from the joint 3 is bent upwardly at an acute angle with respect to the upper side of the ski, projects into a recess 5''a in the pin 5'' and is slidably supported on the inclined, upwardly facing lower surface 5''b of the recess 5''a. When, during cross-country skiing, the rear part 2b of the cross-country plate 2 is swung upwardly about the joint 3, the operating extension 22 on the rear part 2b of the cross-country plate 2 presses the slide member 15 leftwardly and thus deeper into the recess 5''a in the pin 5'', whereby the bent end area of the slide member cooperates with the inclined surface 5''b and pulls the pin 5'' downwardly toward the upper side of the ski against the force of the spring 12''.

Figure 5:
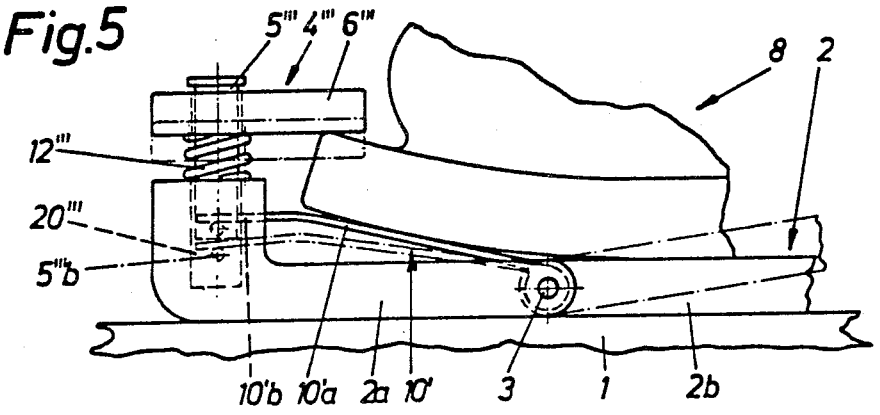
FIG. 5 is a side view of yet another alternative embodiment of the binding of FIG. 1.

FIG. 5 illustrates a further embodiment in which the operating member 10 is again constructed as a pedal. As in the exemplary embodiment according to FIG. 1, the operating member 10' is pivotally supported at the joint 3. The pin 5''' which is connected to the hold-down means 4''' is again movably supported in an opening 20''' in the cross-country plate 2. The sole holder 4''' and the pin 5''' are movable in a vertical direction against the force of a spring 12''' which has its ends supported on the sole holder 4''' and the cross-country plate 2. An operating arm 10'b which is offset from the stepping area 10'a of the operating member 10' extends through an opening in the cross-country plate 2 and has a forklike end which is supported on both sides of the pin 5''' on a pin 5'''b which extends through and is secured in the pin 5'''. As a result, in this exemplary embodiment the sole holder 4''' again follows, during pressing down of the operating member 10', movement of the sole 8a of the shoe 8. The sole holder 4''' always defines a plane parallel to its initial plane.

The invention is not limited to the illustrated exemplary embodiments. Further modifications, including the rearrangement of parts, are conceivable without leaving the scope of protection. Thus, for example, the pin which carries the hold-down means can be secured on the cross-country plate and the sole hold-down means can be supported vertically movably on the pin. In this case, it would be conceivable to secure one end of the rope, band or the like to the hold-down means. Also, it is possible to guide, from the sole hold-down means, a pull rod or the like through a recess of the cross-country plate and to move same by means of a pedal or a slide member. When a continuous and flexible cross-country plate is used, it is easily possible to arrange the pedal, which with one end controls the sole holder, so that its other end is supported in or on the cross-country plate in the area of the ball of the foot by means of a joint.

The embodiments of the invention in which an exclusive property or privilege is claimed are defined as follows:

1. In a safety ski binding adapted to be mounted on a ski for cross-country and downhill skiing, including a cross-country plate having a front portion which supports a sole holder which has hold-down means for releasably holding a sole of a ski shoe, the hold-down means being supported for generally vertical movement by means of a generally vertical recess provided in the cross-country plate and a pin which is provided on the sole holder, said pin extending approximately vertically and being movably supported in the recess, the improvement comprising means for controlling the vertical position of the hold-down means, including an operating member which is operatively coupled to the sole holder, and means responsive to movement of the ski shoe during cross-country skiing for effecting movement of the operating member, wherein during cross-country skiing movement of the ski shoe in a manner causing downward movement of the front end thereof effects movement of the operating member, which in turn effects downward movement of the hold-down means relative to an upper side of the ski.

2. The safety ski binding according to claim 1, wherein the sole holder is yieldably urged away from the upper side of the ski by a spring which is arranged between the cross-country plate and the sole holder.

3. The safety ski binding according to claim 1, wherein the operating member is a pedal which has one end pivotally supported on the cross-country plate and its other end operatively engaging a tilting member provided on the sole holder.

4. The safety ski binding according to claim 3, wherein the recess in the cross-country plate which receives the pin on the sole holder has an upwardly diverging frustoconical surface on a side thereof nearest the operating member, the remaining sides of the recess being generally cylindrical, wherein forces applied to the tilting member by the pedal effect a tilting movement of the sole holder toward the pedal, and wherein the pedal is yieldably urged toward a nonoperated position by a spring cooperable with the cross-country plate and the pedal.

5. The safety ski binding according to claim 3, wherein the tilting member is fixedly connected to the sole holder and has two laterally spaced extensions, and wherein an end of each said extension which faces the operating member has a slot which slidably receives said other end of the pedal.

6. The safety ski binding according to claim 1 or claim 2, wherein the cross-country plate has front and rear parts movably coupled by joint means, and wherein the operating member is an elongate flexible element which has one end secured to the rear part of the cross-country plate in the region of the joint means, is guided for lengthwise movement within the front part of the cross-country plate, and has its other end secured to said pin.

7. The safety ski binding according to claim 1 or claim 2, wherein the cross-country plate has front and rear parts movably coupled by joint means; including an extension provided in the region of the joint means on the rear part of the cross-country plate; wherein the operating member is a slide member which is guided within the front part of the cross-country plate for movement in a plane approximately parallel to the upper side of the ski, a first end of the slide member adjacent the joint means being operatively engageable with the extension and a second end of the slide member remote from the joint means being bent to extend at an acute angle with respect to the upper side of the ski and being supported on a lower surface of an opening provided in the pin; and wherein upward pivotal movement of the rear part of the cross-country plate during cross-country skiing causes the extension thereon to move the slide member toward the pin, the second end of the slide member cooperating with the lower surface of the opening in the pin and causing the pin of the sole holder to move downwardly within the recess in the cross-country plate.

8. The safety ski binding according to claim 2, wherein the operating member is a pedal which has one end pivotally supported on the cross-country plate and its other end operatively coupled to the pin of the sole holder.

9. The safety ski binding according to claim 6, including a roller rotatably supported in said front part of said cross-country plate, said elongate flexible element engaging said roller and said roller facilitating lengthwise movement of said elongate flexible element.

10. A safety ski binding for releasably holding on a ski a ski shoe having a sole with a bottom surface which curves upwardly at a front end thereof, comprising a plate adapted to extend along an upper surface of the ski and to be secured to the ski at a front end thereof, a sole holder having hold-down means adapted to engage an upper side of the ski shoe sole at the front end thereof, means supporting said sole holder on said front end of said plate for movement in a manner effecting approximately vertical movement of said hold-down means, and operating means coupled to said sole holder and responsive to movement of the ski shoe sole which causes downward movement of the front end thereof for moving said sole holder in a manner which effects downward movement of said hold-down means relative to said plate, thereby maintaining said hold-down means in secure engagement with the upper surface of the ski shoe sole.

11. The binding according to claim 10, wherein said front end of said plate has means defining an upwardly open recess therein, wherein said sole holder has a downwardly projecting pin thereon which is movably supported in said recess in said plate and which has means defining a transverse opening therethrough, wherein said plate has an axle supported thereon which extends transversely of the ski through said recess in said plate and through said transverse opening in said pin, said movement of said sole holder being pivotal movement about said axle.

12. The binding according to claim 11, wherein said operating means includes a pedal having one end supported on said plate at a location spaced rearwardly from said front end of said plate for pivotal movement about an approximately horizontal first axis which extends generally transversely of the ski, said pedal being movable between a position adjacent and approximately parallel to said plate and a position extending upwardly and forwardly at an acute angle to said plate, and said pedal being operatively engageable by an underside of the ski boot sole; wherein said operating means includes resilient means yieldably urging said pedal to pivot upwardly relative to said plate; wherein said sole holder has an extension thereon which projects toward the ski shoe and which has means defining a slot in an end thereof nearest the ski shoe; and wherein an end of said pedal remote from said one end thereof is slidably received in said slot in said extension, pivotal movement of said pedal by the ski shoe sole effecting pivotal movement of said sole holder about said axle.

13. The binding according to claim 12, wherein said pin on said sole holder is generally cylindrical, wherein said recess in said plate has an upwardly diverging frustoconical surface on a side thereof nearest the ski shoe, the remaining sides of said recess in said plate being generally cylindrical; and wherein said transverse opening through said pin has, in a sectional top view, an approximately hourglass shape, thereby facilitating limited pivotal movement of said sole holder about a vertical axis relative to said plate.

14. The binding according to claim 13, wherein said plate includes front and rear parts which are pivotally coupled to each other for movement about an approximately horizontal second axis which extends generally transversely of the ski, said front part of said plate being adapted to be releasably secured to the ski and said rear part of said plate being movable between a position adjacent and parallel to the ski and a position extending upwardly and rearwardly relative to the ski; and wherein said first axis about which said pedal pivots is substantially coincident with said second axis about which said rear portion of said plate pivots.

15. The binding according to claim 10, wherein said front end of said plate has means defining an upwardly open recess therein; wherein said sole holder has a downwardly projecting pin thereon which is vertically movably supported in said recess; including resilient means yieldably urging said sole holder upwardly relative to said plate; wherein said plate includes front and rear parts which are pivotally coupled for relative movement about an approximately horizontal pivot axis extending generally transversely of the ski, said front part of said plate being adapted to be secured to the ski and said rear part of said plate being movable between a position adjacent and substantially parallel to the ski and a position extending upwardly and rearwardly at an angle to the ski; and wherein said operating means includes an elongate flexible member guided for lengthwise movement in said front part of said plate, said elongate flexible member having a first end which is fixedly secured to said pin on said sole holder and a second end which extends below said horizontal pivot axis and is fixedly secured to said rear part of said plate at a location spaced radially from said horizontal pivot axis, upward pivotal movement of said rear part of said plate away from the ski effecting lengthwise movement of said elongate flexible element in a direction causing it to pull said sole holder downwardly against the urging of said resilient means.

16. The binding according to claim 10, wherein said front end of said plate has means defining an upwardly open recess therein; wherein said sole holder has a downwardly projecting pin thereon which is vertically movably supported in said recess in said plate, said pin having means defining an opening therein which has an upwardly facing, upwardly and forwardly inclined lower surface; including resilient means yieldably urging said sole holder upwardly relative to said plate; wherein said plate includes a front part and a rear part which are pivotally coupled to each other for relative movement about an approximately horizontal axis extending generally transversely of the ski, said front part of said plate being adapted to be secured to the ski and said rear part of said plate being movable between a position adjacent and substantially parallel to an upper surface of the ski and a position extending upwardly and rearwardly at an acute angle relative to the upper surface of the ski; and wherein said operating means includes a slide member supported on said front part of said plate for movement lengthwise thereof and having a downwardly facing, upwardly and forwardly inclined surface thereon which is adapted to slidably engage said inclined surface on said pin, and includes said rear part of said plate having an extension which is engageable with said slide member, upward movement of said rear part of said plate causing said extension to engage said slide member and move said slide member forwardly, and said inclined surfaces on said slide member and said pin effecting downward movement of said sole holder against the urging of said resilient means in response to forward movement of said slide member.

17. The binding according to claim 10, wherein said plate has means defining an upwardly open recess at said front end thereof; wherein said sole holder has a downwardly projecting pin thereon which is vertically movably supported in said recess in said plate; including resilient means for yieldably urging said sole holder upwardly relative to said plate; and wherein said operating means includes a pedal having a first end which is pivotally supported on said plate at a location spaced rearwardly from said front end of said plate for pivotal movement about an approximately horizontal first axis which extends generally transversely of the ski and having a second end which is operatively coupled to said pin on said sole holder, pivotable movement of said pedal effecting downward movement of said sole holder and said pin against the urging of said resilient means.

18. The binding according to claim 17, wherein said plate includes front and rear parts which are pivotally coupled for relative movement about an approximately horizontal second axis which is substantially coincident with said first axis, said front part of said plate being adapted to be secured to the ski and said rear part of said plate being movable between a position adjacent and substantially parallel to an upper surface of the ski and a position extending upwardly and rearwardly at an acute angle relative to the upper surface of the ski; wherein said second end of said pedal is forked and has portions disposed on opposite sides of said pin on said sole holder; and wherein said pin on said sole holder has a further pin extending transversely therethrough, said portions of said second end of said pedal each having an underside which slidably engages an upper surface on a respective end of said further pin.

* * * * *